US005138234A

United States Patent [19]

Moisin

[11] Patent Number: 5,138,234

[45] Date of Patent: Aug. 11, 1992

[54] CIRCUIT FOR DRIVING A GAS DISCHARGE LAMP LOAD

[75] Inventor: Mihail S. Moisin, Lake Forest, Ill.

[73] Assignee: Motorola, Inc., Schaumburg, Ill.

[21] Appl. No.: 770,395

[22] Filed: Oct. 3, 1991

Related U.S. Application Data

[63] Continuation-in-part of Ser. No. 705,864, May 28, 1991.

[51] Int. Cl.[5] ..... H05B 37/00

[52] U.S. Cl. ..... 315/209 R; 315/226; 315/307; 315/DIG. 7

[58] Field of Search ..... 315/209 R, 209 T, 219, 315/226, 291, 307, DIG. 7

[56] References Cited

U.S. PATENT DOCUMENTS 4,508,996 4/1985 Clegg et al. ..... 315/219 X 4,873,471 10/1989 Dean et al. ..... 315/307 X

*Primary Examiner*—Robert J. Pascal

*Attorney, Agent, or Firm*—Peter D. Hudson

[57] ABSTRACT

A circuit for dimmably driving fluorescent lamps (102, 104, 106) from a DC supply voltage includes: input nodes (174, 176) having input capacitors (184, 186) connected therebetween; a half-bridge transistor inverter (178, 180) connected between the input terminals; a series-resonant LC oscillator (196, 198) coupled in series between the half-bridge transistors and the input capacitors; an output transformer (212) having a primary winding (214) connected in series with the LC inductor (196) and in parallel with the LC capacitor (198) and a secondary winding (216) for connection to the lamp load; and first and second voltage clamp diodes (215A, 215B) connected between an intermediate point on the primary winding and the input nodes respectively. The voltage clamp diodes, in conjunction with the input capacitors, provide significant enhancement in reduction of power transferred to the lamps when the DC supply voltage is reduced, allowing lamp dimming to be simply and efficiently effected by reduction of the DC supply voltage.

11 Claims, 1 Drawing Sheet

CIRCUIT FOR DRIVING A GAS DISCHARGE LAMP LOAD

CROSS-REFERENCE TO RELATED APPLICATION

This application is a continuation-in-part from an earlier U.S. patent application assigned to the same assignee as the present application and having Ser. No. 07/705,864 and filing date May 28, 1991.

BACKGROUND OF THE INVENTION

This invention relates to circuits for driving gas discharge lamps, and particularly, though not exclusively, to circuits for driving fluorescent lamps.

In a typical prior art circuit for driving a plurality of fluorescent lamps, the lamps are driven from a high-frequency oscillating circuit powered, via a rectifier and an inverter, from an AC voltage supply, e.g. an electric utility mains.

In one such typical prior art circuit the high-frequency oscillating circuit is based upon an inductance and a capacitance coupled in series to form a series-resonant combination, and the inverter is based upon two transistor switches connected in a half-bridge configuration.

Typically, in use of such a circuit, a fluorescent lamp load is connected in parallel with the high-frequency oscillating circuit, i.e., in parallel with both the capacitance and the inductance. However, in a modification of this arrangement the fluorescent lamp load may alternatively be connected in parallel with the capacitance but in series with the inductance. Such a modified arrangement is particularly suited to driving gas discharge lamps such as fluorescent lamps which have very pronounced non-linear dynamic characteristics.

In such a modified circuit, the power transferred to the load decreases as the frequency of the circuit increases for a given load, and increases as the load impedance increases for a given working frequency. It is possible to effect controlled dimming of fluorescent lamps driven from such a modified circuit by controlling the circuit's operating frequency in order to control the power transferred to the load. However such a method of controlled dimming suffers several fundamental drawbacks:

Firstly, great care needs to be taken in order to avoid the possibility of the circuit's frequency falling below a critical frequency at which the circuit begins to oscillate in a "capacitive" mode (i.e., with a negative phase angle). Such a mode of oscillation causes transverse cross-conduction currents to flow through the half-bridge switching transistors, leading to their eventual destruction because of the excess power dissipation caused by the cross-conduction currents. This problem is not easy to avoid satisfactorily, since it is otherwise desirable for the circuit to operate near to this critical frequency in order to deliver the highest power to the load at the highest efficiency.

Secondly, the efficiency of the circuit over the range of dimming is compromised. For cost reasons, the circuit is typically designed to deliver the maximum power at the maximum efficiency level, thus reducing the constraints on the sizes of the magnetic elements of the circuit and on the switching transistors which optimally operate close to zero-current switching levels. Once the circuit's frequency increases in order to perform dimming, the transistors' current switching angle increases, forcing the transistors to switch farther away from the zero-current level. Also, the circulating reactive current in the circuit first increases before decreasing, creating a much higher power loss in the circuit over a significant portion of the frequency range. In order to accommodate this increased power loss, the magnetic elements and the switching transistors have to be redesigned with greater tolerances than would otherwise be required.

Thirdly, for a given desired range of dimming, the required range of frequency variation is proportionately greater, due to the non-linear behavior of the fluorescent lamp load. Gas discharge lamps such as fluorescent lamps are well-recognized as presenting a negative impedance over a significant part of their impedance spectrum. Thus, over the negative impedance range, whenever lamp current decreases lamp voltage increases (though at a lower rate), leading to an increase in the equivalent load impedance which makes the circuit draw more power. This behavior runs counter to the objective of dimming by frequency control, over at least a part of the range of frequency variation, and so necessitates a much greater frequency control range in order to accomplish a desired range of dimming.

SUMMARY OF THE INVENTION

In accordance with the invention there is provided a circuit for driving a gas discharge lamp load, the circuit comprising:

- input means for connection to a DC voltage supply;
- input capacitance means coupled to the input means;
- output means for coupling to the gas discharge lamp load;
- inverter means coupled to the input means;
- series-resonant oscillator means coupled between the inverter means and the output means and comprising an inductor and a capacitor coupled in series, the output means being coupled in series with the inductor and in parallel with the capacitor; and
- voltage clamp means coupled between the output means and the input means.

It will be understood that such a circuit allows lamp dimming to be simply and efficiently effected by reduction of the DC supply voltage.

BRIEF DESCRIPTION OF THE DRAWINGS

One fluorescent lamp driver circuit in accordance with the present invention will now be described, by way of example only, with reference to the accompanying drawings, in which.

DESCRIPTION OF THE PREFERRED EMBODIMENT

Figure 1:
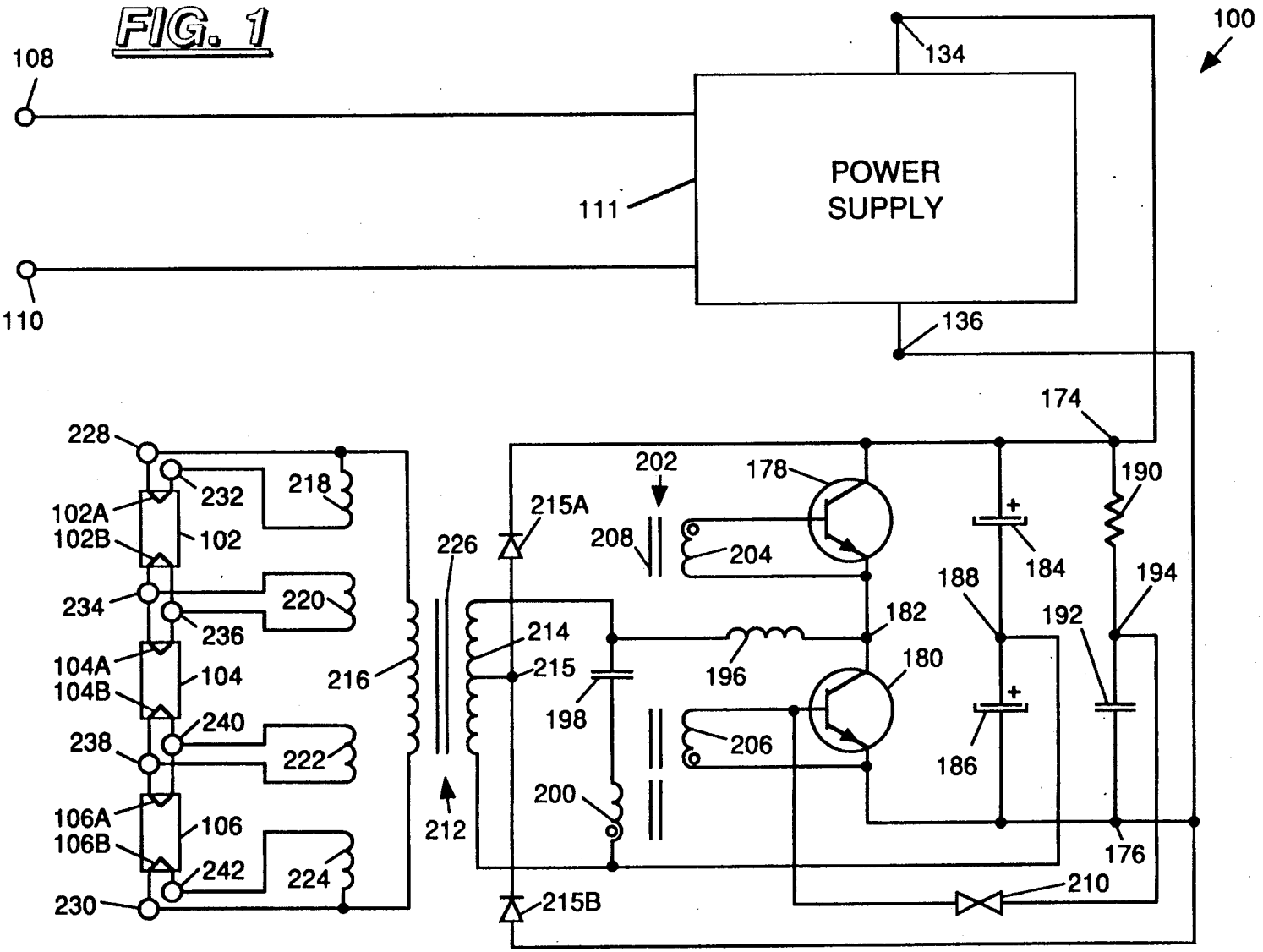
FIG. 1 shows a schematic circuit diagram of a driver circuit for driving three fluorescent lamps.

Referring now to FIG. 1, a circuit 100, for driving three fluorescent lamps 102, 104, 106, has two input terminals 108, 110 for receiving thereacross an AC supply voltage of nominally 120 V at a frequency of 60 Hz. A power supply 111 is connected to the input terminals 108, 110 and to output terminals 134, 136. The power supply 111 receives the AC supply voltage and produces therefrom a DC voltage at the output terminals 134, 136.

The power supply output terminals 134 and 136 are connected to input nodes 174 and 176 of a half-bridge inverter formed by two npn bipolar transistor 178 and 180 (each of the type BUL45). The transistor 178 has its collector electrode connected to the input node 174, and has its emitter electrode connected to an output node 182 of the inverter. The transistor 180 has its collector electrode connected to the node 182, and has its emitter electrode connected to the input node 176. Two electrolytic capacitors 184 and 186 (each having a value of approximately 100 μF) are connected in series the inverter input nodes 174 and 176 via an intermediate node 188. For reasons which will be explained below, a resistor 190 (having a value of approximately 1 MΩ) and a capacitor 192 (having a value of approximately 0.1 μF) are connected in series between the inverter input nodes 174 and 176 via an intermediate node 192.

The inverter output node 182 is connected to a series-resonant tank circuit formed by an inductor 196 (having a value of approximately 0.6 mH) and a capacitor 198 (having a value of approximately 15 nF). The inductor 196 and the capacitor 198 are connected in series, via a primary winding 200 of a base-coupling transformer 202 which will be described more fully below, between the inverter output node 182 and the node 188. The base-coupling transformer 202 includes the primary winding 200 (having approximately 8 turns) and two secondary windings 204 and 206 (each having approximately 24 turns) wound on the same core 208. The secondary windings 204 and 206 are connected with opposite polarities between the base and emitter electrodes of the inverter transistors 178 and 180 respectively. The base electrode of the transistor 180 is connected via a diac 210 (having a voltage breakdown of approximately 32 V) to the node 194.

An output-coupling transformer 212 has its primary winding 214 connected in series with the inductor 196 and in parallel with the capacitor 198 and the primary winding 200 of the base-coupling transformer 202 to conduct output current from the tank circuit formed by the series-resonant inductor 196 and capacitor 198. The primary winding 214 of the transformer 212 is center-tapped at a node 215. The center-tap node 215 is coupled to the inverter input nodes 174 and 176 via a diode clamp formed by two diodes 215A and 215B. The diode 215A has its anode connected to the center-tap node 215 and has its cathode connected to the inverter input node 174. The diode 215B which has its cathode connected to the center-tap node 215 and has its anode connected to the inverter input node 176.

The output-coupling transformer 212 includes the primary winding 214 (having approximately 70 turns), a principal secondary winding 216 (having approximately 210 turns) and four filament-heating secondary windings 218, 220, 222 and 224 (each having approximately 3 turns) wound on the same core 226. The principal secondary winding 216 is connected across output terminals 228 and 230, between which the three fluorescent lamps 102, 104 and 106 are connected in series. The lamps 102, 104 and 106 each have a pair of filaments 102A and 102B, 104A and 104B and 106A and 106B respectively located at opposite ends thereof. The filament-heating secondary winding 218 is connected across the output terminal 228 and an output terminal 232, between which the filament 102A of the lamp 102 is connected. The filament-heating secondary winding 220 is connected across output terminals 234 and 236, between which both the filament 102B of the lamp 102 and the filament 104A of the lamp 104 are connected in parallel. The filament-heating secondary winding 222 is connected across output terminals 238 and 240, between which both the filament 104B of the lamp 104 and the filament 106A of the lamp 106 are connected in parallel. The filament-heating secondary winding 224 is connected across the output terminal 230 and an output terminal 242, between which the filament 106B of the lamp 106 is connected.

The power supply 111 may be of any convenient form such as, for example, that described in U.S. patent application Ser. No. 07/665,830, which is assigned to the same assignee as the present application, and the disclosure of which is hereby incorporated herein by reference.

The transistors 178 and 180, the inductor 196, the capacitor 198 and their associated components form a self-oscillating inverter circuit which produces, when activated, a high-frequency (e.g. 40 KHz) AC voltage across the primary winding 214 of the output-coupling transformer 212. The voltages induced in the secondary windings 218, 220, 222 and 224 216 of the output-coupling transformer serve to heat the lamp filaments 102A and 102B, 104A and 104B and 106A and 106B and the voltage induced in the secondary winding 216 of the output-coupling transformer serves to drive current through the lamps 102, 104 and 106. The detailed operation of such a self-oscillating inverter circuit is described more fully in, for example, U.S. patent application Ser. No. 705,856, which is assigned to the same assignee as the present application, and the disclosure of which is hereby incorporated herein by reference.

In operation of the circuit of FIG. 1, when the circuit is first powered-up, the power supply 111 initially produces at the output terminals 134, 136 a DC output voltage of approximately 170 V, then (after a delay of approximately 0.7 seconds) produces at the output terminals a voltage of approximately 250 V. When the self-oscillating inverter is powered by the DC voltage of approximately 170 V from the power supply 111, the self-oscillating inverter produces enough voltage in the transformer primary winding 214 for the induced currents in the secondary windings 218, 220, 222 and 224 to heat the filaments 102A and 102B, 104A and 104B and 106A and 106B, but does not produce enough voltage for the induced voltage in the secondary winding 216 to cause the lamps 102, 104 and 106 to strike. When the self-oscillating inverter is powered by the DC voltage of approximately 250 V from the power supply 111, the self-oscillating inverter produces enough voltage in the transformer primary winding 214 for the induced voltage in the secondary winding 216 to cause the lamps 102, 104 and 106 to strike and for the induced voltage in the secondary windings 218, 220, 222 and 224 to continue to cause the filaments 102A and 102B, 104A and 104B and 106A and 106B to be heated.

It will be understood that in the self-oscillating inverter formed by the transistors 178 and 180, the inductor 196, the capacitor 198 and their associated components, the inductor 196 and the capacitor 198 form an LC series-resonant circuit which, energized by the applied voltage across the output terminals 134 and 136 via the inverter formed by the transistors 178 and 180, resonates at a nominal loaded frequency of approximately 40 KHz. The high-frequency voltage produced by the resonant circuit appears across the primary winding 214 of the transformer 212 and induces a relatively high voltage in the secondary winding 216 and relatively low voltages in the secondary windings 218, 220, 222 and 224. The relatively low voltages in the secondary windings 218, 220, 222 and 224 produce heating currents in the filaments and the relatively high voltage in the secondary winding 216 is applied across the three lamps 102, 104 and 106 in series, and will cause the lamps to strike if the voltage across the secondary winding 216 is high enough.

In steady-state operation of the lamps, the circuit 100 provides regulated operation by the power supply 111 drawing less current, if the applied voltage varies above its nominal level of 120 V.

As the applied voltage varies below its nominal level of 120 V, the power supply 111 continues to provide regulation, maintaining constant power drawn from the line, so long as the applied voltage does not fall below 115 V.

In the event that the applied voltage falls below 115 V, the circuit draws less power, in the following way. As the applied voltage falls below 115 V and the above-described regulation by the power supply 111 is lost, the power drawn by the circuit of FIG. 1 falls initially at approximately the same rate as the applied voltage falls.

As the applied voltage continues to fall, the power drawn by the circuit of FIG. 1 is caused to fall at a faster rate than the rate of fall of the applied voltage in the following way. As the applied voltage falls, the voltage produced across the terminals 134 and 136 falls, as does the high-frequency voltage produced by the self-oscillating inverter and applied to the lamp load. As will be understood, the fluorescent lamps 102, 104 and 106, once struck, present a negative load (i.e., a load across which the current increases as the voltage across the load falls). As the voltage across the lamps falls due to falling applied line voltage, the current through the lamps increases due to their negative resistance characteristic. The increased lamp current flows through the secondary winding 216 of the output-coupling transformer 212 and is reflected back to the transformer's primary winding 214, causing an increase in the voltage across the primary winding. The increased voltage across the primary winding 216 causes the magnitude of the voltage at the center-tap node 215 to increase. When the voltage at the center-tap node 215 increases above the voltage at the inverter input node 174, the diode 215A becomes forward biased, causing the excess voltage at the node 215 to charge the capacitor 184. Similarly, when the voltage at the center-tap node 215 falls below the voltage at the inverter input node 176, the diode 215B becomes forward biased, causing the excess voltage at the node 215 to charge the capacitor 186. As the capacitors 184 and 186 charge from the diodes 215A and 215B, they supply the energy to power the self-oscillating inverter, and cause less power to be drawn from the utility mains supply line connected across the mains input terminals 108 and 110. In this way, as the applied line voltage falls below the value at which the diodes 215A and 215B become forward biased, the power drawn from the utility mains supply line is caused to fall at a greater rate than the fall in the applied line voltage. This increased rate of fall is not constant but becomes even greater as the applied voltage falls further.

Thus, it will be appreciated that the power drawn by the circuit of FIG. 1 has three distinct phases: a first phase in which the drawn power is regulated at a constant level when the mains supply voltage is above a level slightly less than its nominal value of 120 V (approximately 95% of its nominal value); a second phase in which the drawn power falls at the same rate as the mains supply voltage when the mains supply voltage falls to between approximately 95% and 90% of its nominal value of 120 V; and a third phase in which the drawn power falls at a faster rate than the mains supply voltage when the mains supply voltage falls below approximately 90% of its nominal value.

Thus it will be understood that the circuit of FIG. 1 draws constant power if the mains supply voltage rises above its nominal value of 120 V or if the mains supply voltage falls to no less than approximately 95% of its nominal value of 120 V, thus providing constant light output in all "normal" line conditions where the mains supply line voltage may occasionally rise above its nominal level if significant other users of the mains cease to draw power therefrom, or may occasionally fall slightly below its nominal value if significant other users of the mains begin to draw power therefrom. Alternatively, if the mains supply voltage falls below approximately 95% of its nominal value, the circuit of FIG. 1 draws reduced power. Since a fall in the mains supply voltage below approximately 95% of its nominal value is typically indicative of a "brown-out" or deliberate reduction of mains supply voltage by the electric utility in order to reduce power consumption, the reduced power drawn by the circuit of FIG. 1 under these conditions allows the electric utility to achieve its indicated aim.

It will also be understood that by providing a dual rate power reduction if the mains supply voltage falls below approximately 95% of its nominal value (a first rate, proportional to the fall in mains supply voltage, if the mains supply voltage falls to between approximately 95% and 90% of its nominal value, and a second rate, greater than the fall in mains supply voltage, if the mains supply voltage falls to less than approximately 90% of its nominal value) the circuit of FIG. 1 reduces its power drawn at different rates depending on whether the mains supply voltage is above or below a predetermined threshold, enabling the electric utility to bring about a much more rapid reduction in power consumption (if desired) by reducing the mains supply voltage below approximately 90% of its nominal value.

In normal operation of the circuit of FIG. 1, with the AC mains supply voltage applied between input terminals 108 and 110 having a value at or above 115 V, the lamps 102, 104 and 106 produce their full maximum illumination. From the foregoing discussion of the operation the "voltage-clamp" diodes 215A and 215B in conjunction with the capacitors 184 and 186, it will be appreciated that the circuit of FIG. 1 also allows dimming of the lamps to be effected in a manner which avoids the several disadvantages of "dimming by frequency control" discussed above in the Background of the Invention.

With lamps 102, 104 and 106 struck and the applied AC mains supply voltage having a value at or above 115 V, the lamps may be dimmed by reducing the DC voltage produced at the power supply output terminals 134 and 136 below its normal value of approximately 250 V. The power supply 111 may be arranged in a conventional manner to produce a reduced DC output voltage, e.g., in response to "dimming" operation of a switch (not shown). Such a power supply and switch are described more fully in, for example, U.S. patent application Ser. No. 739,048, which is assigned to the same assignee as the present application, and the disclosure of which is hereby incorporated herein by reference In normal operation of the circuit of FIG. 1, with the applied AC mains supply voltage having a value at or above 115 V, with the DC output voltage of the power supply 111 having a value of approximately 250 V, and with the lamps struck and producing their maximum illumination, the "voltage-clamp" diodes 215A and 215B are reverse biased and effectively play no part in circuit operation. However, when the DC output voltage of the power supply 111 falls below approximately 250 V, the "voltage-clamp" diodes 215A and 215B become forward biased, as described above. When the "voltage-clamp" diodes 215A and 215B become forward biased, current will begin to be re-circulated back to the nodes 174 and 176 and will charge the capacitors 184 and 186, as described above.

The effect of this operation of the forward biased diodes 215A and 215B in conjunction with the capacitors 184 and 186 is to decrease the power transferred to the lamp load, and therefore to effect dimming of the lamps. It will be appreciated such dimming of the lamps is brought about in the following ways:

(i) As the "voltage-clamp" diodes 215A and 215B become forward biased, the current re-circulated back to the nodes 174 and 176, combined with the current flowing to the lamp load, will effectively reduce the equivalent load impedance. As described above, under these conditions the load will inherently draw less power.

(ii) As the lamps draw less power, the lamp current will decrease, causing the lamp voltage to increase in accordance with the negative impedance characteristic of the lamps. This increase in lamp voltage will cause more current to flow through the diodes 215A and 215B, providing a positive feedback mechanism which enhances the dimming effect.

(iii) The lowering of the DC output voltage from the power supply 111 directly reduces the power applied to the self-oscillating inverter, which directly produces a dimming effect, although the dimming enhancing action of the voltage-clamp diodes 215A and 215B and the capacitors 184 and 186 contributes significantly more to the overall dimming than that attributable directly to the reduction in input power to the self-oscillating inverter.

It will further be appreciated that throughout the dimming process described above, the frequency of operation of the self-oscillating inverter of the circuit of FIG. 1 remains substantially constant.

It will further be understood that as the amount of dimming of the lamps increases, the effective equivalent load impedance decreases as described above. This increases the conduction phase angle of the inverter transistors 178 and 180 and so increases the margin of safety against "capacitive" mode switching compared with "dimming by frequency control" as discussed above in the Background of the Invention. In the circuit of FIG. 1 the inverter transistors 178 and 10 can therefore be designed to switch normally close to the zero current level which produces maximum power transfer.

It will further be appreciated that as the lamps dim, the equivalent load impedance increases due to higher levels of clamp current flowing through the diodes 215A and 215B, even though the impedance of the lamps increases. This acts to counteract the negative impedance effect of the lamps which necessitates a proportionately wider range of control in order to effect a given range of dimming using "dimming by frequency control" as discussed above in the Background of the Invention. In the circuit of FIG. 1 therefore the required range of DC voltage variation of the power supply output for a given range of dimming is proportionately reduced.

It will thus be appreciated that the circuit of FIG. 1 provides enhanced circuit efficiency over a desired range of dimming.

It will be appreciated that although in FIG. 1 there has been described a circuit for driving three fluorescent lamps, the invention is not restricted to the driving of three fluorescent lamps. It will be understood that the invention is also applicable to circuits for driving other numbers and/or types of lamps.

It will also be appreciated that the voltage levels involved in effecting dimming in the circuit of FIG. 1, may be varied as desired.

It will be appreciated that various other modifications or alternatives to the above described embodiment will be apparent to a person skilled in the art without departing from the inventive concept of producing dimming of a driven gas discharge lamp by the use of a voltage clamped, series-resonant oscillator supplied from a variable DC voltage.

I claim:

1. A circuit for driving a gas discharge lamp load, the circuit comprising:

input means for connection to a DC voltage supply;

input capacitance means coupled to the input means;

output means for coupling to the gas discharge lamp load;

inverter means coupled to the input means;

series-resonant oscillator means coupled between the inverter means and the output means and comprising an inductor and a capacitor coupled in series, the output means being coupled in series with the inductor and in parallel with the capacitor; and voltage clamp means coupled between the output means and the input means.

2. A circuit according to claim 1 wherein the input means comprises differential input nodes and the capacitance means comprises first and second input capacitors connected in series via a capacitance intermediate node between the differential input nodes, the series-resonant means being coupled to the capacitance intermediate node.

3. A circuit according to claim 2 wherein the first and second input capacitors have substantially equal capacitance values.

4. A circuit according to claim 1 wherein the output means comprises a transformer having a primary winding coupled in series with the series-resonant means' inductor and coupled in parallel with the series-resonant means' capacitor, and a secondary winding for coupling to the gas discharge lamp load.

5. A circuit according to claim 1 wherein the inverter means comprises first and second switch means connected as a half-bridge.

6. A circuit according to claim 5 wherein the first and second switch means each have a control input transformer-coupled to the series-resonant means.

7. A circuit according to claim 5 wherein the first and second switch means are bipolar transistors.

8. A circuit according to claim 1 wherein the voltage clamp means comprises diode means coupled between the output means and the input means.

9. A circuit according to claim 8 wherein the input means comprises differential input nodes and the diode means comprises first and second diodes connected in series via a diode intermediate node between the differential input nodes, and wherein the output means comprises a transformer having a primary winding coupled in series with the series-resonant means' inductor and coupled in parallel with the series-resonant means' capacitor, the diode intermediate node being coupled to an intermediate point on the primary winding.

10. A circuit for driving a gas discharge lamp load, the circuit comprising:

differential input means having differential input nodes for connection across a DC voltage supply;

first and second input capacitors coupled via a capacitance intermediate node in series between the differential input nodes;

an inverter having first and second switch means coupled via an inverter intermediate node between the differential nodes, the first and second switch means having respectively first and second control inputs;

a series-resonant oscillator comprising an inductor and a capacitor coupled in series between the inverter intermediate node and the capacitance intermediate node, the series-resonant oscillator being coupled to the first and second control inputs;

an output transformer having a primary winding coupled in series with the series-resonant oscillator's inductor and coupled in parallel with the series-resonant oscillator's capacitor, and having a secondary winding for coupling to the gas discharge lamp load; and first and second voltage clamp diodes coupled via a diode intermediate node in series between the differential nodes, the diode intermediate node being coupled to an intermediate point on the primary winding.

11. A circuit for driving a gas discharge lamp load, the circuit comprising:

input means for connection to a DC voltage supply;

input capacitance means coupled to the input means;

output means for coupling to the gas discharge lamp load;

inverter means coupled to the input means and including switch means having a control input;

series-resonant oscillator means coupled between the inverter means and the output means and comprising an inductor and a capacitor in series, the series-resonant oscillator means being coupled to the control input means of the switch means and the output means being coupled in series with the inductor and in parallel with the capacitor; and diode voltage clamp means coupled between the output means and the input means.

* * * * *